US009011081B2

(12) United States Patent
Gomez et al.

(10) Patent No.: US 9,011,081 B2
(45) Date of Patent: Apr. 21, 2015

(54) BLADE

(75) Inventors: Sergio Elorza Gomez, Munich (DE); Rudolf Selmeier, Fahrenzhausen (DE); Wilfried Schutte, Oberhaching (DE); Peter Eibelshauser, Munich (DE); Harald Passrucker, Salzburg (AT); Manfred Dupslaff, Eichenau (DE)

(73) Assignee: MTU Aero Engines GmbH, Munich (DE)

( * ) Notice: Subject to any disclaimer, the term of this patent is extended or adjusted under 35 U.S.C. 154(b) by 568 days.

(21) Appl. No.: 13/388,367

(22) PCT Filed: Aug. 5, 2010

(86) PCT No.: PCT/DE2010/000920

§ 371 (c)(1),
(2), (4) Date: Feb. 1, 2012

(87) PCT Pub. No.: WO2011/015193

PCT Pub. Date: Feb. 10, 2011

(65) Prior Publication Data

US 2012/0128480 A1 May 24, 2012

(30) Foreign Application Priority Data

Aug. 6, 2009 (DE) ..... 10 2009 036 406

(51) Int. Cl.

| | |
|---|---|
| ***F01D 5/14*** | (2006.01) |
| ***F01D 17/16*** | (2006.01) |
| ***F04D 29/68*** | (2006.01) |
| ***F04D 29/56*** | (2006.01) |
| ***F04D 29/54*** | (2006.01) |

(52) U.S. Cl.

CPC ..... *F01D 5/141* (2013.01); *F01D 5/145* (2013.01); *F01D 17/162* (2013.01); *F04D 29/681* (2013.01); *F05D 2250/713* (2013.01); *F05D 2250/711* (2013.01); *F04D 29/563* (2013.01); *F04D 29/544* (2013.01)

(58) Field of Classification Search

CPC ..... F01D 5/141; F01D 5/145; F01D 17/16; F04D 29/542; F04D 29/563; F04D 29/681; F05D 2250/713; F05D 2250/711

USPC ..... 415/160, 191, 151

See application file for complete search history.

(56) References Cited

U.S. PATENT DOCUMENTS

| | | | | |
|---|---|---|---|---|
| 2,918,254 | A * | 12/1959 | Hausammann | 415/116 |
| 6,179,559 | B1 * | 1/2001 | Weaver | 415/161 |
| 6,283,705 | B1 | 9/2001 | Rice et al. | |

(Continued)

FOREIGN PATENT DOCUMENTS

| | | | |
|---|---|---|---|
| DE | 1923535 | A1 | 1/1970 |
| DE | 2841616 | A1 | 3/1979 |
| DE | 19913269 | A1 | 9/2000 |

(Continued)

*Primary Examiner* — Edward Look

*Assistant Examiner* — Danielle M Christensen

(74) *Attorney, Agent, or Firm* — Barlow, Josephs & Holmes, Ltd.

(57) ABSTRACT

The present invention relates to a blade of a turbomachine, in particular an adjustable guide blade or vane of a gas turbine, having at least one thickened area (18) on a pressure side (D) of the blade profile (P), wherein the thickened area (18) is disposed in a radially outer-lying, housing-side region of the blade (10), wherein the thickened area (18) is designed at a distance from a front edge (12) and a rear edge (14) of the blade (10).

10 Claims, 4 Drawing Sheets

(56) References Cited

U.S. PATENT DOCUMENTS

| | | | | |
|---|---|---|---|---|
| 6,565,324 | B1 * | 5/2003 | Phillipsen et al. | 416/236 R |
| 2003/0143079 | A1 * | 7/2003 | Kawarada et al. | 416/243 |
| 2005/0079060 | A1 * | 4/2005 | MacManus | 416/235 |
| 2006/0140768 | A1 * | 6/2006 | Tam et al. | 416/193 A |
| 2007/0258817 | A1 * | 11/2007 | Allen-Bradley et al. | 416/193 A |

FOREIGN PATENT DOCUMENTS

| | | | |
|---|---|---|---|
| DE | 102004026386 | A1 | 12/2005 |
| EP | 0789447 | A2 | 8/1997 |
| EP | 1591624 | A1 | 11/2005 |
| EP | 1712737 | A1 | 10/2006 |
| WO | 2005106207 | A1 | 11/2005 |

* cited by examiner

Prior Art

Prior Art

BLADE

The present invention relates to a blade or vane of a turbomachine, in particular an adjustable guide vane of a gas turbine, with at least one thickened area on a pressure side of the blade profile, wherein the thickened area is disposed in a radially outer-lying, housing-side region of the blade.

These types of blades for turbomachines are known from DE 28 41 616, DE 10 2004 026 386 and EP 0 789 447 B1. The disclosed thickened areas of the blades in particular serve for minimizing the so-called secondary flow losses. The thickened area of the blade in this case is formed each time in the housing-side and/or hub-side suction and pressure region of the blade. The known thickened areas of the blade profile in the housing-side region are also necessary in order to counteract the high static stresses chiefly occurring on the housing side of adjustable guide blades or vanes of compressors. The known peripheral thickened areas, i.e., those formed on the suction and pressure side, however, have aerodynamic disadvantages.

It is thus the problem of the present invention to provide a blade of the type named initially, which has a relatively thin, aerodynamically favorable blade profile with simultaneously improved strength.

This problem is solved by a blade according to the features of claim 1.

Advantageous embodiments of the invention are described in the respective subclaims.

A blade or vane of a turbomachine according to the invention, in particular an adjustable guide vane of a gas turbine, comprises at least one thickened area on a pressure side of the blade profile, wherein the thickened area is disposed in a radially outer-lying, housing-side region of the blade and the thickened area is formed at a distance from a front edge and a rear edge of the blade. According to the invention, a complete circumferential thickened area of the radially outer-lying, housing-side regions of the blades is dispensed with. Advantageously, thin, aerodynamically favorable blade profiles can thus be designed that have the required strength, however, due to the locally enhanced thickened area. Stresses in the region of the housing side, in particular high static stresses that occur in the region of a housing-side rotary plate with adjustable blades, can also be minimized thereby. By means of an optimized shaping of the thickened area, it is also possible that the static pressure can be reduced locally in the pressure-side region of a guide vane formed according to the invention. The intensity of the gap or leakage flow is advantageously reduced thereby in this region.

In advantageous embodiments of the blade according to the invention, the thickened area is formed as a convex contour within the overall concave contour of the pressure side of the blade profile. The convex contour or the at least partially convex configuration of the thickened area has been demonstrated to be advantageous in terms of fluid mechanics. The thickened area can also have its maximum profile thickness in the housing-side end region of the blade. In this way, the profile thickness of the thickened area can decrease continually, proceeding from the maximum profile thickness down to a standard profile thickness of the blade profile without thickened area. These configurations of the thickened area have also been demonstrated to be particularly advantageous with respect to fluid-mechanics requirements in this region.

In another advantageous embodiment of the blade according to the invention, the thickened area extends maximally up to a height of the region of the blade on the housing and pressure side that corresponds to 25% of the blade height. It has turned out that such a dimensioning of the thickened area assures the necessary strength of the blade in the housing-side region. Also, most of the regions of the blade may have a relatively thin, aerodynamically optimized blade profile.

In other advantageous embodiments of the blade according to the invention, the distance between the front edge of the blade and the thickened area in the housing-side end region of the blade amounts to at least 15% of a chord length of the blade in this end region. Also, the convex contour of the thickened area at each end of the thickened area can run tangentially to the concave contour of the pressure side of the blade profile. The thickened area can be formed at least partially in bead or hump shape. These configuration possibilities for the thickened area also include the possibility of the formation of an aerodynamically favorable blade profile with a simultaneously improved strength of the blade for the equilibration of stresses occurring on the housing side.

In other advantageous embodiments of the blade according to the invention, the latter is joined on the housing side to a rotary plate mounted in a rotatable manner in a housing of the turbomachine. In this way, the front edge and the rear edge of the blade can be disposed completely within the diameter of the rotary plate. It is also possible, however, that the front edge and/or the rear edge of the blade project(s) over the rotary plate. For the case in which the rear edge of the blade projects over the rotary plate, it has been demonstrated as advantageous that the thickened area terminates outside the diameter of the rotary plate. Stresses at the edge of the rotary plate in particular can be reduced in a targeted manner thereby.

A turbomachine according to the invention, in particular a gas turbine with stator and/or rotor blades comprises a plurality of blades according to the embodiment examples of the invention described in the preceding. A compressor according to the invention of a turbomachine, in particular a high-pressure compressor of a gas turbine, comprises stator blades with a plurality of blades according to one of the embodiment examples described in the preceding.

Other advantages, features and details of the invention result from the following description of two examples of embodiment shown in the drawing. Here FIG. 1 shows a schematic representation of a blade without a thickened area according to the prior art;

Figure 1:
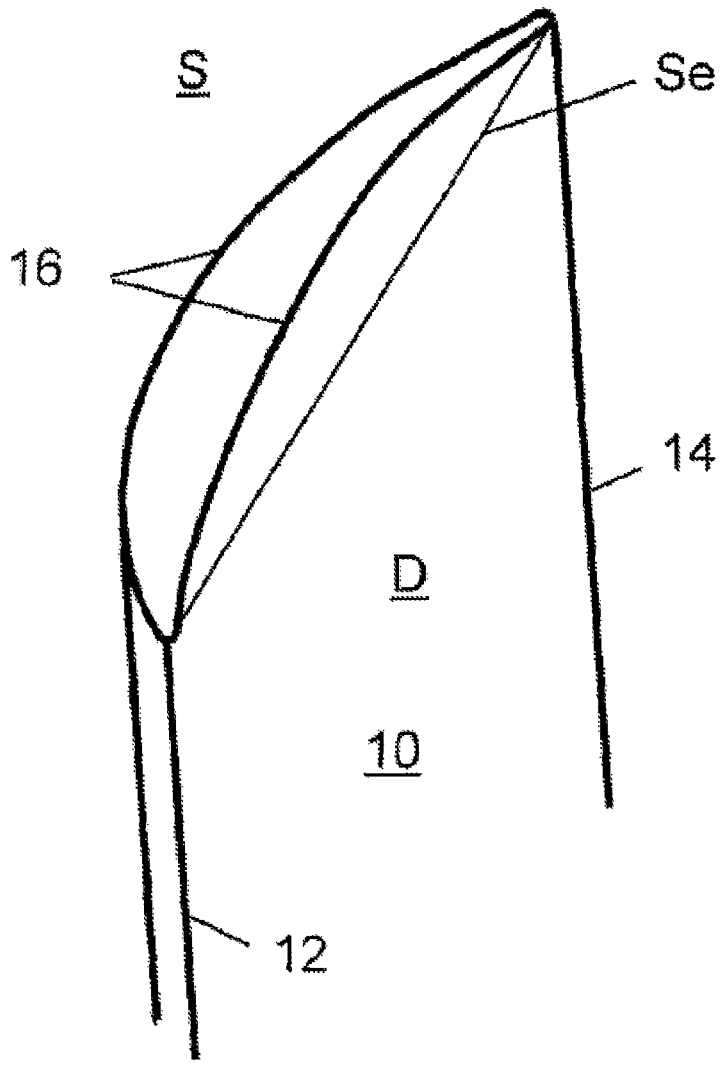

FIG. 1 shows a schematic representation of a blade 10 without a thickened area according to the prior art. Blade 10 has a usual blade contour 16, wherein blade contour 16 is formed concave overall on the pressure side D of blade 10 and convex overall on suction side S of blade 10. The chord length Se of blade 10 is usually defined as the linear distance between the front edge 12 and the rear edge 14 of the respective profile section.

Figure 2:
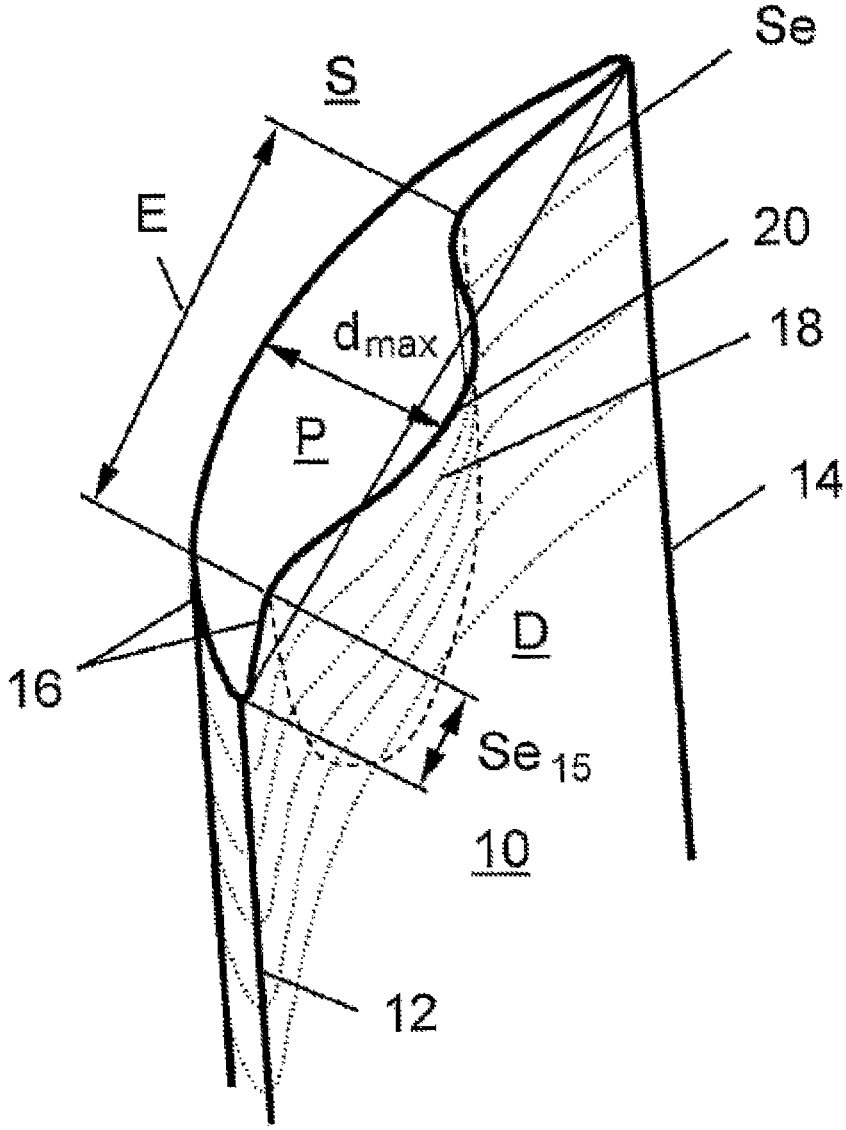
FIG. 2 shows a schematic representation of a blade according to the invention.

FIG. 2 shows a schematic representation of a blade 10 according to one example of embodiment of the invention. Blade 10 involves a blade of a turbomachine, in particular an adjustable guide vane of a gas turbine. It is recognized that blade 10 has a thickened area 18 on a pressure side D of the blade profile P, wherein the thickened area 18 is disposed in a radially outer-lying, housing-side region of blade 10. The housing is not shown in this representation. The blade profile P is formed and defined by a blade contour 16. In this case, it is clear that the thickened area 18 is formed as a convex contour 20 within the overall concave contour of the pressure side D of the blade profile P. The extent E of thickened area 18 is selected in this case such that thickened area 18 is formed overall at a distance from the front edge 12 and the rear edge 14 of blade 10. Here, the distance between front edge 12 and thickened area 18 in the housing-side end region of blade 10 that is shown amounts to approximately 15% of the chord length Se of blade 10 in this end region. This distance is characterized by $Se_{15}$.

In addition, it can be recognized that thickened area 18 has its maximum profile thickness $d_{max}$ in the housing-side end region of blade 10. Proceeding from this maximum profile thickness $d_{max}$, the profile thickness d in the direction of the end region lying opposite to the housing-side end region of blade 10—usually a hub region of a turbomachine—decreases continuously down to a standard profile thickness $d_{norm}$ of the blade profile P without thickened area 18. In addition, it is clear that convex contour 20 of thickened area 18 at the ends of thickened area 18 runs tangentially to the concave contour of the pressure side D of the blade profile P. It is recognized that thickened area 18 is formed at least partially in hump shape.

Figure 3:
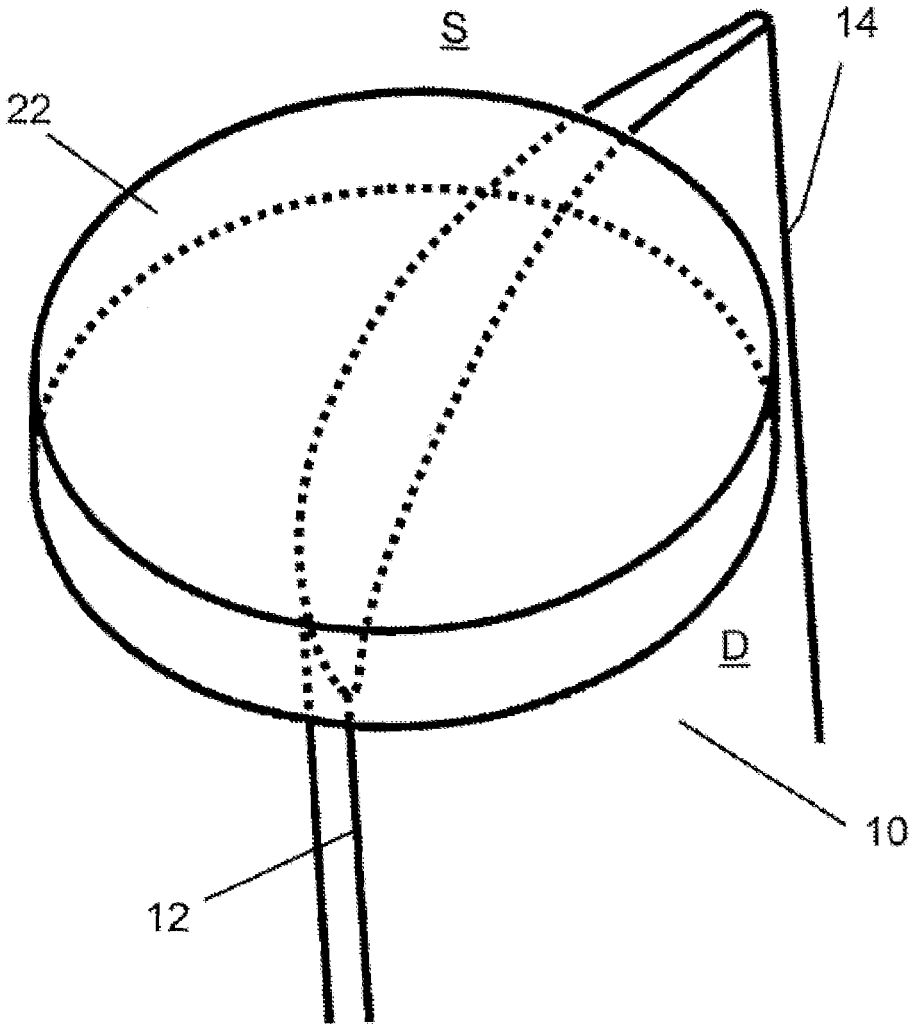
FIG. 3 shows a schematic representation of a blade disposed on a rotary plate without a thickened area according to the prior art.

FIG. 3 shows a schematic representation of a blade 10 disposed on a rotary plate 22 and without a thickened area according to the prior art. Blade 10 in this case is disposed on rotary plate 22 in such a way that its front edge 12 projects on rotary plate 22 and its rear edge 14 projects over the diameter of rotary plate 22.

Figure 4:
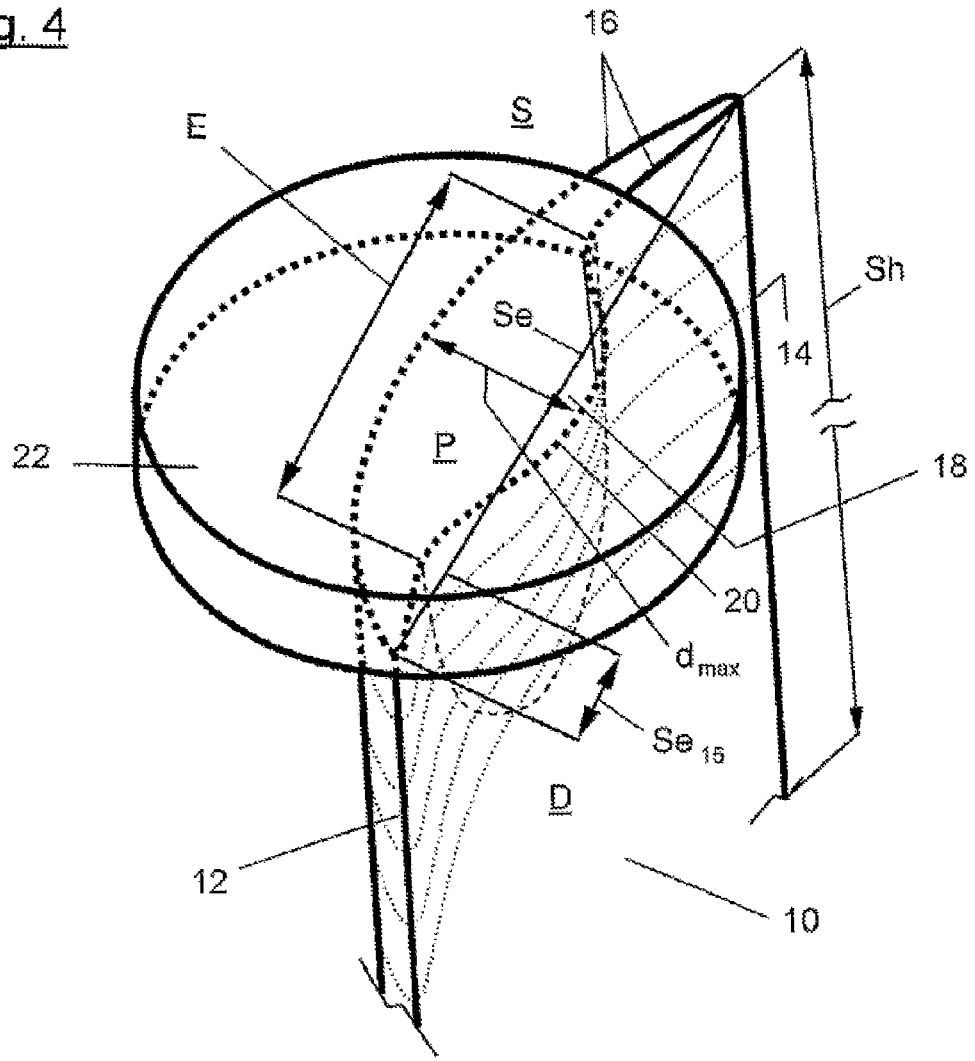
FIG. 4 shows a schematic representation of a blade according to the invention disposed on a rotary plate according to a second embodiment.

FIG. 4 shows a schematic representation of a blade 10 disposed on a rotary plate 22 according to a second embodiment of the invention. Rotary plate 22 in this case serves for adjusting blade 10 and is mounted in a rotatable manner inside a housing of the turbomachine. Blade 10 in the embodiment example shown is disposed on rotary plate 22 in such a way that its front edge 12 of blade 10 projects on rotary plate 22 and its rear edge 14 projects over the diameter of rotary plate 22. It is again clear that thickened area 18 is formed at a distance from front edge 12 and rear edge 14 of blade 10. Thickened area 18 has its maximum profile thickness $d_{max}$ in the housing-side end region of blade 10 which is shown. The profile thickness d of thickened area 18 in turn decreases continually, proceeding from the maximum profile thickness $d_{max}$ down to a standard profile thickness $d_{norm}$ of the blade profile P. In addition, it is clear that thickened area 18 extends maximally up to a height of the housing-side and pressure-side region of blade 10 that corresponds to 25% of the blade height Sh. From this representation of the blade profile P as also the representation shown in FIG. 2, it is clear that the maximum profile thickness $d_{max}$ of thickened area 18 projects beyond the imaginary line of the chord length Se. In this case, the thickened area 18 shown in FIG. 4 relative to the thickened area 18 shown in FIG. 2 has a greater extent E over the pressure side D of blade 10. In addition, it is clear that thickened area 18 terminates outside the diameter of rotary plate 22.

The example of embodiment shown is part of a stator blading of a compressor of a turbomachine, in particular, a high-pressure compressor of a gas turbine.

The invention claimed is:

1. An adjustable guide vane of a gas turbine, having at least one thickened area (18) defined in a blade in a pressure side (D) of the blade profile (P), wherein the thickened area (18) is disposed in a radially outer-lying, housing-side region of blade surface (10), wherein thickened area (18) is formed at a distance from a front edge (12) and a rear edge (14) of blade (10) and wherein the thickened area (18) is a convex contour (20) within the overall concave contour of the pressure side (D) of the blade profile (P) when the blade is viewed along a radial direction, whereby in the radially outer-lying, housing side region of blade surface (10) a first concave portion extends between the front edge (12) of the blade (10) and the thickened area (18), and whereby a second concave portion extends between the thickened area (18) and the rear edge (14) of the blade (10), wherein, on the housing side, blade (10) is joined to a rotary plate (22) mounted in a rotatable manner in a housing, wherein rear edge (14) projects over rotary plate (22) and thickened area (18) terminates outside of the diameter of rotary plate (22).

2. The adjustable guide vane according to claim 1, wherein thickened area (18) has its maximum profile thickness ($d_{max}$) in the housing-side end region of blade (10).

3. The adjustable guide vane according to claim 2, wherein a profile thickness (d) of thickened area (18) decreases continually, proceeding from the maximum profile thickness ($d_{max}$) down to a standard profile thickness ($d_{norm}$) of blade profile (P) without thickened area (18).

4. The adjustable guide vane according to claim 1, wherein thickened area (18) extends maximally up to a height of the housing-side and pressure-side region of blade (10) that corresponds to 25% of the blade height (Sh).

5. The adjustable guide vane according to claim 1, wherein the distance between front edge (12) of blade (10) and thickened area (18) in the housing-side end region of blade (10) corresponds to at least 15% of a chord length (Se) of blade (10) in this end region.

6. The adjustable guide vane according to claim 1, wherein convex contour (20) of thickened area (18) at each of the ends of thickened area (18) runs tangentially to the concave contour of the pressure side (D) of the blade profile (P).

7. The adjustable guide vane according to claim 1, wherein thickened area (18) is formed at least partially in bead or hump shape and wherein, on the housing side, blade (10) is joined to a rotary plate (22) mounted in a rotatable manner in a housing, wherein rear edge (14) projects over rotary plate (22) and thickened area (18) terminates outside of the diameter of rotary plate (22).

8. The adjustable guide vane according to claim 1, wherein front edge (12) and/or rear edge (14) of blade (10) project(s) over rotary plate (22).

9. An adjustable guide vane of a gas turbine, having at least one thickened area (18) defined in a blade in a pressure side (D) of the blade profile (P), wherein the thickened area (18) is disposed in a radially outer-lying, housing-side region of blade surface (10), wherein thickened area (18) is formed at a non-zero distance from a front edge (12) and a rear a rear edge (14) of blade (10) wherein the thickened area (18) is a convex contour (20) within the overall concave contour of the pressure side (D) of the blade profile (P) when the blade is viewed along a radial direction and wherein, on the housing side, blade (10) is joined to a rotary plate (22) mounted in a rotatable manner in a housing, wherein rear edge (14) projects over rotary plate (22) and thickened area (18) terminates outside of the diameter of rotary plate (22)

wherein thickened area (18) has its maximum profile thickness ($d_{max}$) in the housing-side end region of blade (10), and wherein the maximum profile thickness ($d_{max}$) of thickened area (18) projects beyond an imaginary line of a chord length (Se) of blade (10).

10. An adjustable guide vane of a gas turbine, having at least one thickened area (18) defined in a blade in a pressure side (D) of the blade profile (P), wherein the thickened area (18) is disposed in a radially outer-lying, housing-side region of blade surface (10), wherein thickened area (18) is formed at a distance from a front edge (12) and a rear edge (14) of blade (10) wherein the thickened area (18) is a convex contour (20) within the overall concave contour of the pressure side (D) of the blade profile (P) when the blade is viewed along a radial direction and wherein, on the housing side, blade (10) is joined to a rotary plate (22) mounted in a rotatable manner in a housing, wherein rear edge (14) projects over rotary plate (22) and thickened area (18) terminates outside of the diameter of rotary plate (22), and wherein the distance between front edge (12) of blade (10) and thickened area (18) in the housing-side end region of blade (10) corresponds to at least 15% of a chord length (Se) of blade (10) in this end region.

* * * * *